United States Patent [19]

Ahola et al.

[11] Patent Number: 4,553,943

[45] Date of Patent: Nov. 19, 1985

[54] METHOD FOR SHOOTING PRACTICE

[75] Inventors: Raimo Ahola; Harri Kopola; Risto Myllylä, all of Oulu, Finland

[73] Assignee: Noptel Ky, Oulu, Finland

[21] Appl. No.: 595,922

[22] Filed: Apr. 2, 1984

[30] Foreign Application Priority Data

Apr. 8, 1983 [FI] Finland ..... 831183

[51] Int. Cl.[4] ..... F41G 3/26

[52] U.S. Cl. ..... 434/22; 273/310

[58] Field of Search ..... 273/310; 434/21, 22

[56] References Cited

U.S. PATENT DOCUMENTS

| | | | |
|---|---|---|---|
| 2,826,677 | 3/1958 | Jobanek | 273/310 X |
| 3,633,285 | 1/1972 | Sensney | 273/310 X |
| 3,964,178 | 6/1976 | Marshall et al. | 434/22 X |
| 4,164,081 | 8/1979 | Berke | 434/22 |
| 4,177,580 | 12/1979 | Marshall et al. | 434/22 |
| 4,195,422 | 4/1980 | Budmiger | 273/310 X |
| 4,452,458 | 6/1984 | Timander et al. | 273/310 |

*Primary Examiner*—William H. Grieb

*Attorney, Agent, or Firm*—Scully, Scott, Murphy & Presser

[57] ABSTRACT

An optic method for shooting practice in which a narrow light beam is used instead of a bullet. The light beam is provided by a light transmitter (2) of a visible or infrared area attachable to a gun, the ray transmitted by which transmitter is observed with a spot-sensitive optic detector (5, 6) from which is received continuous position information during aiming and discharging as well as, when desired, also the hit and the direction at the discharge instant (9). (FIG. 1).

7 Claims, 1 Drawing Figure

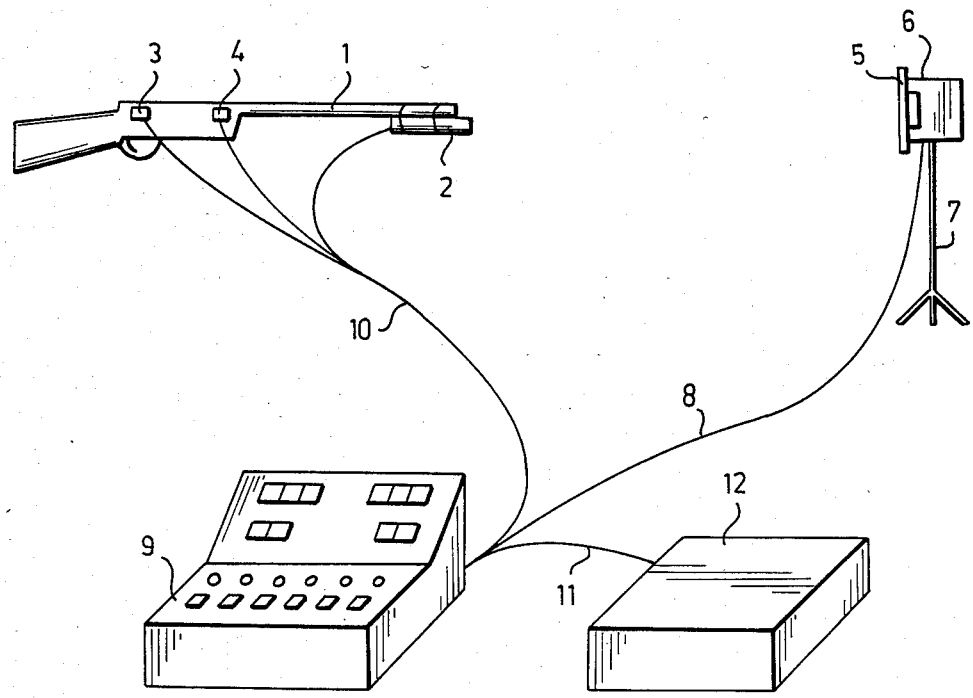
3
4
1
2
6
5
7
10
8
12
9
11

METHOD FOR SHOOTING PRACTICE

The present invention relates to an optic method for shooting practice. In the method a narrow light beam is used instead of a bullet. Thus it is possible to practise, e.g., in normal indoor places. The use of a continuous sensing makes it possible to follow the movement of the gun during aiming and discharging which leads to effective analysing of the performance situation.

The use of a light beam instead of a bullet in shooting practice is previously known. However, the methods in use are not suitable when practising alone, because a video camera is usually used to indicate the ray. The result is shown in a visual form on a television monitor from which another person takes down the result. Another way is to use a fluorescent plate to indicate the ray. The light transmitter is constructed in the device mentioned above into a separate gun, whereat the same gun cannot be used in practice as in competitions.

In the present invention one gets from the receiver the position of the centre of radiation hitting the detector as a continuous electric signal proportional to the x- and y-coordinates. As the most important characteristics of the method in accordance with the invention can be considered that it is possible to analyse the movement of the gun during the process of aiming and discharging and to write it out as a continuous curve with, e.g., a plotter. Thus important information of principal value from the viewpoint of training is received. Furthermore, normal firing can be simulated with the method, because the hits are displayed, e.g., on a numerical display and can be recorded in the storage, whereat, e.g., the average result and the deviation as well as the amount of each hit value can be had from a series of chosen length. Furthermore, it is an essential advantage that all normal guns can be used in connection with this method without making changes on them. Further, it follows from the method that the results can be scaled resiliently to correspond with standardized target sizes depending on the range, the gun type and the manner of firing. By adjusting the sight suitably one can also fire at the normal target beside the detector-even use bullets-and get results corresponding to the situation by availing oneself of the scaling possibility.

In order to provide the characteristics described above, the invention is mainly characterized by the facts described in claim 1.

In the following the invention is described more in detail by means of examples referring to the enclosed drawing, wherein FIG. 1 shows a sensing equipment adapted to the method.

In FIG. 1 a semiconductor laser transmitter 2 is attached with clamps to a commercial miniature gun 1, which transmitter can be, e.g., of the type LCW-5 produced by MIACOM, USA, and in which the IR-radiation transmitted by a laser diode is converged to a narrow beam with a converging lens. The transmitter 2 is not switched on by a separate connector 3 until the time for careful aiming for, among other things, security reasons. By means of an acoustic sensor 4 attached to the miniature gun 1 the discharge instant is determined by acoustic waves advancing in the gun body and caused by the firing pin.

The target is constructed for a coloured glass filter 5 letting through only IR-radiation. Behind the coloured glass filter 5 there is a spot-sensitive light diode detector

6 in the sensor, which detector can be, e.g., of type SC-50 produced by UDT, USA, and its amplifier electronics. With a spot-sensitive detector the position of the centre of the transmitted IR-radiation is identified as an x- and y-coordinate. The target is attached to an adjustable tripod 7 for placing the target on the right level for firing laying down, on knee and standing up.

The x- and y-coordinate received from the amplifier electronics are transmitted as frequency information along cables 8 to the control, display and analyse unit 9. The unit 9 is of type ST-1000 produced by Noptel Ky, Oulu, Finland, and it comprises primarily a microcomputer and the interface, display and output electronics it requires. The transmitter 2, the connector 3 and the sensor 4 are connected by cables 10 to the unit 9. The connector 3 permitting, current pulses with a repetition frequency of about 4 kHz are directed from the unit 9 to the transmitter. A conventional xy-plotter 12 or other corresponding output device is controlled by means of the unit 9 by cables on the basis of x- and y-coordinate information obtained from the received IR-light. Simultaneously as the transmitter 2 begins to function, the plotter follows the position of the light spot hitting the target continuously drawing a trajectory. The continuous tracing and drawing of the trajectory of the light spot is from the viewpoint of shooting practice and training something substantial which makes possible the careful analysing of the performance situation.

There are furthermore numerical displays for conventional firing simulation for showing the separate hit and its direction as well as the amount of shots in the series and the total of hits. The instant when taking a sample for the hit point of the transmitted ray is determined in the unit 9 on the basis of a suitable delay depending on the cartridge and the gun and on the basis of the discharge instant given by the sensor 4 to the unit 9. The delay is adjusted so that the instant when taking a sample corresponds as well as possibly to the instant at which the bullet leaves (or for firing simulation would leave) the gun barrel. The delay can easily be chosen electronically to be the desirable in the unit 9.

The hit values of the target are scaled electronically in the unit 9 on the basis of standard target sizes determined in accordance with the gun and the firing range. The equipment is made to be used for firing ranges of both 10 m and 25 m.

It is evident for one skilled in the art that the different embodiments of the invention are not limited only to the example described above but can vary within the scope of the claims described here below.

What is claimed is:

1. A method for analyzing the aiming and firing process in shooting practice, comprising:

a. attaching an optical electromagnetic radiation light transmitter to the gun which is used for shooting process;

b. actuating said light transmitter to produce a light beam at least during the aiming and firing process;

c. converting the trajectory of the hitting point of said light beam on a target surface, with an electro-optical device having a position sensitive detector, to continuous electric signals representing continuously the position of the hitting point of said beam on said target surface;

d. generating a timing signal by a sensor attached to the gun and reacting to the movement of a drive element, as a trigger, parts attached thereto, firing pin and butt, moving when said gun is discharged for determining the discharge instant of said gun;

e. further processing said continuous electric signals representing the position of the hitting point of said beam on said target surface and said timing signal by a control, display and analyze unit connected to said electro-optic device and said sensor generating a timing signal; and f. displaying the information in the further processed signals.

2. A method in accordance with claim 1, wherein in the further processing the momentary hitting point of the beam on said target surface is detected by sampling the continuous electric signals at a proper time determined by the timing signal, sampling at least one continuous electric signal, and displaying the position information in at least one said sampled signal.

3. A method in accordance with claim 1, wherein said further processing includes scaling the electric signals in said control, display and analyze unit to simulate different types of shooting, on the basis of features characteristic of the different types of shooting, as gun type, firing position, firing range and target size.

4. A method in accordance with claim 1, further comprising displaying the trajectory of said light beam on said target surface in the form of processed signals by a device, as a plotter or video monitor, providing a two-dimensional display surface.

5. A method in accordance with claim 1, wherein said timing signal is delayed in said control, display and analyze unit to the extent of a delay between the instant when a bullet would leave, if a bullet were used, the gun barrel and the reacting instant of said sensor.

6. A method in accordance with claim 1, wherein the hit point is displayed as a number value and as a reading of the time showing the deviation direction of the hit from the center by displays provided at said control, display and analyze unit.

7. A method in accordance with claim 1, wherein the information of said continuous electric signals indicating the trajectory of said light beam on said target surface during a limited period is stored before output into a data recording device, as a tape recorder or a digital memory, coupled to said control, display and analyze unit.

* * * * *